US006142195A

United States Patent [19]

Lin

[11] Patent Number: 6,142,195

[45] Date of Patent: Nov. 7, 2000

[54] QUICK RELEASE CONTAINER CLAMP

[75] Inventor: Yu-Liang Lin, Hsin-Chu, Taiwan

[73] Assignee: Taiwan Semiconductor Manufacturing Co., Ltd., Hsinchu, Taiwan

[21] Appl. No.: 09/285,144

[22] Filed: Apr. 1, 1999

[51] Int. Cl.[7] ..... B65B 11/04; B65B 1/04; B67C 3/00

[52] U.S. Cl. ..... 141/383; 141/369; 141/372; 141/375; 141/386

[58] Field of Search ..... 141/346, 363–366, 141/368, 369, 372, 375, 383, 386, 269; 285/406, 420; 222/180; 220/238, 244, 481; 215/280, 284, 304, 322, 324

[56] References Cited

U.S. PATENT DOCUMENTS 2,575,870 11/1951 Gates ..... 222/80
2,989,093 6/1961 Stiebel ..... 141/278
3,097,673 7/1963 Hunt ..... 141/272
5,832,972 11/1998 Thomas et al. ..... 141/360

*Primary Examiner*—Charles R. Eloshway
*Assistant Examiner*—Timothy L. Maust
*Attorney, Agent, or Firm*—Tung & Associates

[57] ABSTRACT

A quick release device clamps a conventional threaded bottle or similar container on structure such as processing equipment mounting head to allow rapid replacement of the bottle. The clamp includes a U-shaped clamping member in the form of a plate which slides under a flange or lip of the threaded bottle neck. A pair of hold-downs hinged to the clamping plate by overcenter linkages are adapted to respectively receive a pair of ears on the mounting head. The linkages include levers which when manually operated to an overcenter position, lock the bottle into tight sealing engagement with the processing equipment head.

14 Claims, 2 Drawing Sheets

QUICK RELEASE CONTAINER CLAMP

TECHNICAL FIELD

The present invention broadly relates to apparatus for removably mounting containers, such as a bottle, on processing equipment such as that used to manufacture semiconductor devices, and deals more particularly with a quick release system for removably clamping the container on a mounting head.

BACKGROUND ART

Containers, such as bottles are often removably mounted on various structures to permit removal and refilling or replacement of the bottle and its contents. For example, in connection with processes used to manufacture semiconductor devices, bottles filled with additive gasses are removeably mounted on heads which are coupled with gas lines used to supply inert or reactive gasses to a processing chamber in which any of various types of processes such as PVD, CVD, etching, diffusion, ion implantation, etc. are carried out. Such containers often comprise a simple bottle formed of glass, for example, having a reduced diameter neck provided with a set of external threads. The threaded neck of the bottle is received within a threaded, female cylindrical opening of a processing equipment head, so that the bottle can be installed and removed simply by spinning it on or off of the head.

When the gas within has been nearly depleted, or the use of a different gas is required, then the bottle must be removed and either refilled or replaced. As with many threaded interconnections, installing the bottle too loosely can result in leakage past the threads, whereas overtightening the bottle can make unscrewing it very difficult. When the bottle is screwed onto the head too tightly, and it becomes necessary to apply an inordinate amount of force or other techniques such as wrapping the bottle or head to loosen the threads, the impact or vibrations set up by these actions can sometimes dislodge minute, foreign particles resident within either the bottle or interior surfaces of the head. These foreign particles are often carried into the stream of gas flow and find their way into the processing chamber. Such foreign particles represent impurities that can be deposited onto semiconductor device substrates which damage or ruin the devices being manufactured, thus resulting in scrap and reduction of product yield.

In addition to the problem of introducing contaminants into the gas flow, and possible leakage of gas from the bottle, spin-on type gas bottles used in semiconductor manufacturing processes typically result in unnecessary long down time of the processing equipment, simply because of the additional time required to install and un-install the bottle properly.

Accordingly, there is a clear need in the art for an improved means of removably mounting bottle-like containers on process mounting heads which overcomes each of the deficiencies of the prior art mentioned above.

BRIEF DESCRIPTION OF THE INVENTION

According to one aspect of the invention, a quick release clamp is provided for clamping a container on a structure such as a processing head wherein the container is of the type including a neck provided with a radially extending lip. The clamp includes a generally U-shaped clamping member insertable around the neck of the container and positioned beneath the lip so as to engage the latter. Releasable clamping means are provided which are carried on the U-shaped member for clamping the container on the processing head. Retaining means carried on the mounted head are engageable by and cooperate with the clamping means such that the bottle can be quickly clamped on and removed from the mounting head, without the need for screwing the bottle onto the head. The releasable clamping means preferably comprises a pair of overcenter clamping mechanisms provided with clamping heads that engage and clamp down on a pair of ears secured to the mounting head, so as to draw the U-shaped clamping member toward the head, thus forcing the neck of the bottle into tight, sealing engagement with the head. The U-shaped member and releasable clamping means are hingedly connected together, such that upon release of the clamping means, the latter along with the U-shaped member may be quickly removed from both the mounting head and the bottle.

According to another aspect of the invention, a quick release system is provided for removably mounting a container, wherein the container is the type having a threaded cylindrical neck provided with a radially extending lip. The system includes a stationary mounting head having a cylindrical opening therein, such opening having an inside diameter equal to or greater than the outside diameter of the threaded neck, whereby to receive the container neck therein. A pair of mounting ears are secured on opposite sides of the head. A first clamping member having an opening in one side thereof is installed around the neck and includes an upper clamping surface that engages the bottle neck lip, in face to face engagement therewith. A pair of clamping assemblies each include a second clamping member for engaging and clamping against one of the ears, and are manually operable from a first position clamping the container on the head to a second position releasing the container from the head. Means are provided for mounting the clamping assemblies on the first clamping member such that the latter may be completely removed from both the mounting head and the container.

Accordingly, it is a primary object of the present invention to provide a quick release clamp for clamping a container on a structure, such as a processing head, which eliminates the need for spinning a threaded bottle onto the head.

A further object of the invention is to provide a system as described above which can be used with standard, conventional bottles provided with threaded necks, thus eliminating the need for specialized bottles.

A further object of the invention is to provide a system as described above which allows rapid installation and removal of bottles with a minimum amount of force or vibration so as to reduce the possibility of deployment of contaminant particles into either the bottle or the stream of flow of its contents.

A still further object of the present invention is to provide a system as described above which requires a lower level of operator skill for changing out bottles and provides a higher level of repeatability compared with prior art spin-on type bottles.

These, and further objects and advantages of the present invention will be made clear or will become apparent during the following description of the preferred embodiment of the invention.

BRIEF DESCRIPTION OF THE DRAWINGS

In the drawings, which form an integral part of the specification and are to be read in conjunction therewith, and in which like reference numerals are employed to designate identical components in the various views.

DETAILED DESCRIPTION OF THE PREFERRED EMBODIMENTS

Figure 1:
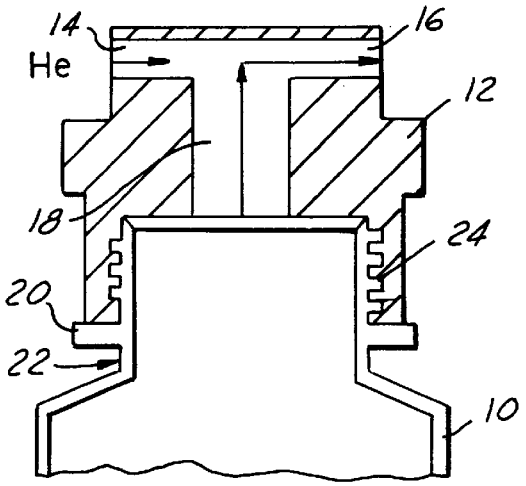
(PRIOR ART) FIG. 1
FIG. 1 is a side view of a prior art spin-on type bottle installed on a processing mounting head.
Figure 2:
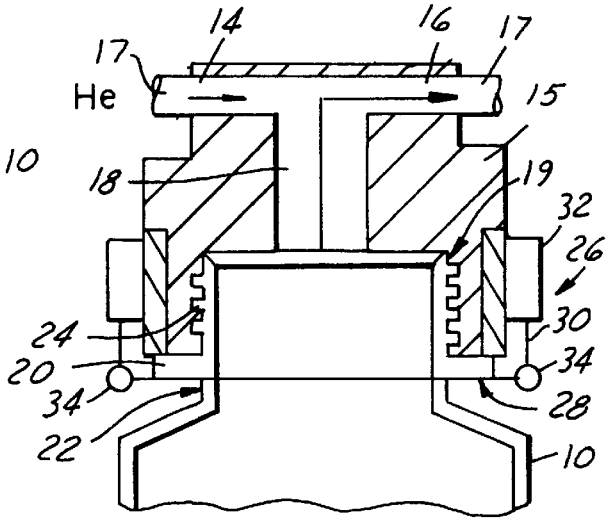
FIG. 2 is a view similar to FIG. 1 but depicting the quick release clamping system of the present invention.
Figure 3:
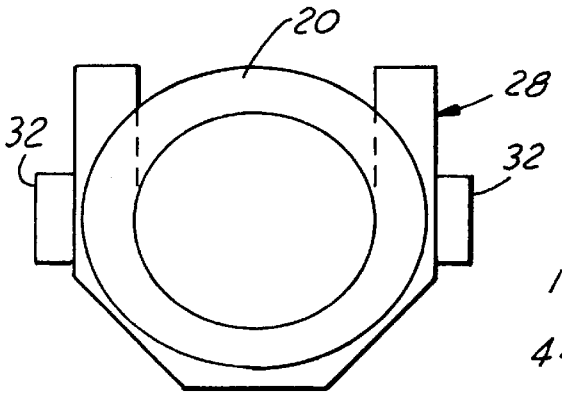
FIG. 3 is a plan view of the mounting head and bottle of FIG. 2.

Referring first to FIG. 1, numerous types of processing systems such as those used to manufacture semiconductor devices employ small amounts of chemicals or materials that are added to a fluid material flowing through conduits to processing apparatus, such as a processing chamber. For example, in the case of semiconductor manufacturing processes, a particular primary gas, such as helium, is introduced into a processing chamber (not shown) and it is necessary to add a small amount of a second, gaseous element to form an admixture in the chamber. The adding of this secondary gas is accomplished by introducing a small amount of the secondary gas into the stream of flow of primary gas through a conduit 17 leading from a source (not shown) of helium to the chamber. The secondary gas is housed in a container such as a glass, "spin-on" bottle 10 carried on a mounting head 12. The bottle 10 includes a reduced neck portion 22 provided with a set of spiral threads 24 which terminate at their lower end in a radially extended flange or lip 20. The head 12 includes a central threaded opening for matingly receiving the threads 24, thus providing a threaded mount, whereby the bottle 10 can be installed and removed from the head simply by spinning the bottle. The head includes a central passageway 18 which communicates with an inlet 14 and outlet 16 that are respectively coupled with the conduit 17. The lip 20 defines a stop which engages the lower end of the head 12, thus defining the point of maximum longitudinal displacement of the bottle 10 when the latter is spun onto the head 12.

In use, the primary gas flowing through the conduit 17 enters the inlet 14 and exits at the outlet 16, while the secondary gas within the bottle flows upwardly through the passageway 18 and is drawn into the stream of flow of the primary gas.

As previously discussed, the mounting system of FIG. 1 has a number of drawbacks, including the time required to spin the bottle on and off the head 12, the difficulty in achieving repeatability in the amount of torque applied to the bottle 10, the tendency of the threads 24 to stick, making bottle removal difficult, and the possibility of dislodging contaminating particles during installation or removal of the bottle.

Figure 4:
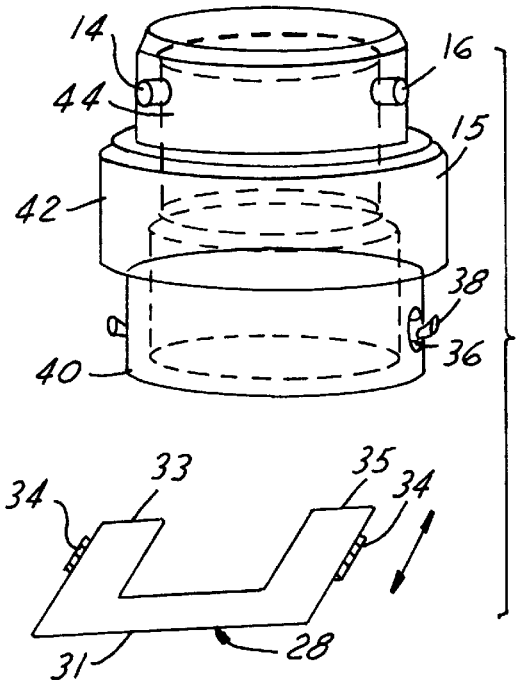
FIG. 4 is an exploded, perspective view of the mounting head and bottle shown in FIG. 2.
Figure 5:
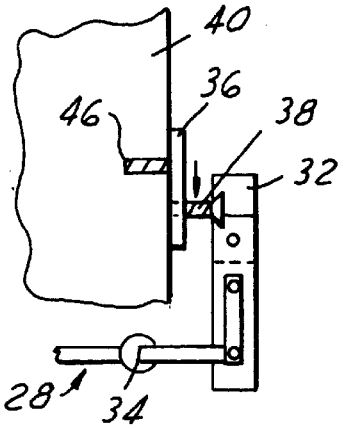
FIG. 5 is a fragmentary, enlarged side view of the quick release clamping system shown in FIGS. 2–4.
Figure 6:
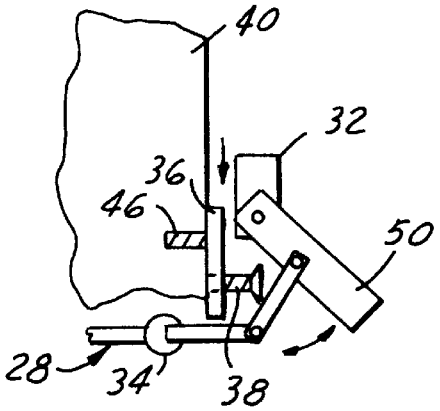
FIG. 6 is a view similar to FIG. 5 but showing the clamping assembly in a released position.
Figure 7:
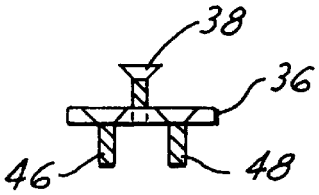
FIG. 7 is a top view of one of the ears forming part of the system shown in FIG. 2–6.
Figure 8:
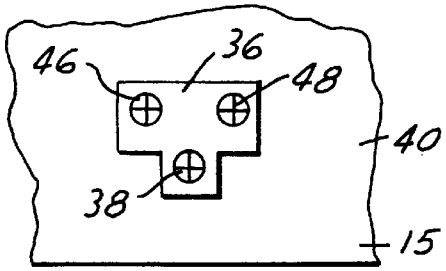
FIG. 8 is a fragmentary, front view of the ear shown in FIG. 7.
Figure 9:
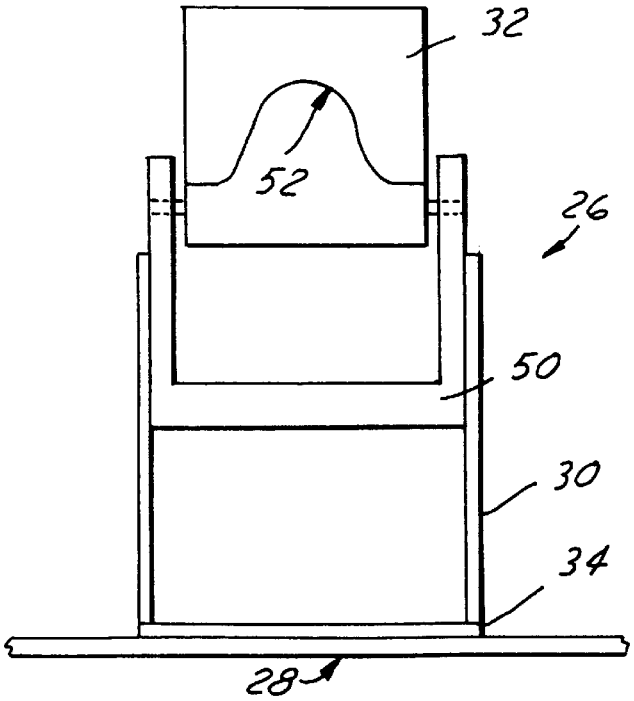
FIG. 9 is a side view of one of the clamping assemblies, shown in its released position.

In order to eliminate these aforementioned disadvantages of the prior art mounting system shown in FIG. 1, a quick release clamping system is provided in accordance with the present invention which is depicted in FIGS. 2–9. The clamping system of the present invention includes a bottle 10, identical to that shown in FIG. 1, and a head 15 similar, but not identical to the head 12 shown in FIG. 1. Like the mounting head 12 in FIG. 1, the modified head 15 includes an inlet 14, an outlet 16 and a central passageway 18 communicating with the interior of the bottle 10. As best seen in FIG. 4, the head includes upper and lower cylindrical portions 40, 44, and a central cylindrical portion 42 of enlarged diameter. However, unlike the threaded interior central passageway of head 12 shown in FIG. 1, head 15 in FIG. 2 possesses a central cylindrical opening having an outside diameter 19 which is essentially the same as or marginally greater than that of the threads 24, thus allowing the bottle 10, and particularly the neck 22 to be passed longitudinally into the central opening of the head 15, without the need for spinning action, as is required in the system shown in FIG. 1. Furthermore, the mounting head 15 includes a pair of ear assemblies (as seen in FIGS. 5–8) mounted on opposite sides of the lower cylindrical portion 40. Each of these ear assemblies includes a mounting plate 36 fastened to the side of the head 15 by means of a pair of screws 46, 48. Further, an ear like fastening extension is defined by a screw 38 held by threads in a plate 36 thus, as best seen in FIG. 4, the two ear extensions 38 extend radially outwardly in diametric opposite directions relative to the head 15.

A clamping member 28 is provided in the form of a U-shaped plate 28 having a bight 31, and a pair of generally parallel legs 33, 35 extending therefrom. The clamping member 28 has a flat upper surface, with the spacing between the legs 33, 35 being such that the neck 22 can be passed through the open end of the clamp member 28 so that the upper surface of the member 28 engages the bottom face of the bottle lip 20. A pair of clamping assemblies 26 are respectively mounted on legs 33, 35 by means of a corresponding pair of pivotal connections in the form of hinges 34 carried on legs 33, 35. Each of the clamping assemblies 26 includes a first link 30 having its lower end pivotally connected to the clamp member 28 by means of hinges 34, a second link 50 pivotally connected to the an upper end of the first link 30, and a clamping member 32 pivotally connected to the second link 50. The clamp member 32 is provided, on its interior face with a hollowed out arcuately shaped pocket 52 which is configured to receive therein and engage an outer head portion of the ear extension 38. The pivotal connections between the links 30, 50 and clamp member 32 are selected such that an overcenter linkage is formed which, as will be described below, can be manually operated to clamp and lock the bottle 10 onto the head 15.

In use, in order to install a fresh bottle 10 onto the head 15, the bottle 10 is moved longitudinally up into the central opening of the head 15 until the clamping assemblies 26 are aligned with the ear extensions 38. Each of the clamping members 32 is then pivoted so that the extension 38 is captured within the pocket 52, whereupon link 50 is pivoted downwardly, thus moving clamping members 32 down into engagement with the ear extensions 38. This overcenter movement of the linkages transmits a force to the clamping member 28 which draws the latter upwardly toward the ear extensions 38, in turn applying a force to the bottle lip 20 which moves the bottle upwardly into tight sealing engagement with the head 15. Continued downward movement on the link 50, to the position shown in FIG. 5, causes the clamp assemblies 26 to lock into place, and in turn locking the bottle 10 in the head 15.

In order to remove or exchange a bottle 10, the links 50 are simply moved outwardly and upwardly, thereby releasing the clamping members 32 from the ear extensions 30, whereupon the clamping members 32 may be moved outward to clear the ear extensions 38. At this point, the bottle 10 may be moved longitudinally downward away from the head 15. Then, the clamp member 28, along with the clamping assemblies 26 may be slid away from the bottle 10 and installed on a fresh bottle which is then installed using the installation procedure described above.

From the forgoing, it is apparent that the quick release clamping system described above not only provides for the reliable accomplishment of the objects of the invention, but does so in a particularly effective and economical manner. It is recognized, of course, that those skilled in the art may make various modifications and additions chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A quick-release clamp for clamping a container on a structure, said container including a neck provided with a radially extending lip, comprising:

a generally U-shaped member insertable around said neck, and positionable beneath said lip; said U-shaped member includes an open end through which said container neck may be easily passed to allow quick removal of said container from said clamp and said structure;

releasable clamping means adapted to be mounted on said structure engageable by and cooperating with said radially extending lip, said clamping means further includes a clamping member for engaging and clamping against a retaining means, said clamping member includes a pocket for receiving said retaining means therein, a manually operable overcenter linkage coupled between said clamping member and said U-shaped member, said linkage being operable between a released position releasing said clamping member from said retaining means, and an overcenter clamping position clamping said container onto said structure.

2. The quick release clamp of claim 1, wherein said over center linkage includes:

a first link having one end thereof hingedly connected with said U-shaped member, a second link hingedly connected with the opposite end of said first link, and wherein said clamping member is hingedly connected with said second link.

3. The quick release clamp of claim 1, wherein said retaining means includes an ear extending outwardly from said structure.

4. The quick release clamp of claim 1, wherein said U-shaped member includes a generally flat surface engageable in face to face contact with said lip.

5. The quick release clamp of claim 1, wherein said U-shaped member and said releasable clamping means are releasable from said structure and said container.

6. The quick release clamp of claim 1, wherein:

said U-shaped member includes a bight and a pair of spaced apart legs, and a clamping means includes a pair of linkages each including a clamping member for clamping against said retaining means, said quick release clamp further including a pair of hinges for respectively hingedly mounting said linkages on legs.

7. A quick release system for removably mounting a container, said container being the type having a threaded cylindrical neck provided with a radially extending lip, comprising:

a stationary mounting head having a cylindrical opening therein, said opening having an inside diameter equal to or greater than the outside diameter of said neck, whereby to receive said neck therein;

a pair of mounting ears on opposite sides of said head;

a first clamping member having an opening in a side thereof through which said neck may pass, and an upper clamping surface engageable with said lip, when said clamping member is installed on said container, said first clamping member is generally U-shaped and includes a bight and a pair of legs extending from said bight;

a pair of clamping assemblies each including a second clamping member for engaging and clamping said ears, said clamping assemblies being manually operable from a first position clamping said container on said head to a second position releasing said container from said head; and means for mounting said clamping assemblies on said first clamping member, said mounting means includes a pair of hinges respectively carried on said legs.

8. The quick release system of claim 7, wherein each of said clamping members further includes an overcenter linkage.

9. The quick release system of claim 8, wherein said over center linkage includes:

a first link having one end thereof hingedly connected with said first clamping member, and a second link hingedly connected with the opposite end of said first link.

10. The quick release system of claim 7, wherein said clamping member includes a pocket for receiving one of said ears therein.

11. The quick release system of claim 7, wherein said first clamping member includes a generally flat upper surface engageable in face to face contact with said lip.

12. The quick release system of claim 7, wherein said first clamping member and each of said clamping assemblies is releasable from said head and from said container.

13. The quick release system of claim 7, wherein each of said ears includes:

a plate, a laterally extending portion carried on said plate and engageable with said clamping member, and means for securing said plate on said head.

14. The quick release system of claim 13, wherein said ears are disposed on opposite sides of said head.

* * * * *